US007155894B2

(12) United States Patent
Gatzke et al.

(10) Patent No.: US 7,155,894 B2
(45) Date of Patent: Jan. 2, 2007

(54) RECEIVING ELEMENT FOR A YARN DRAWING NOZZLE OF AN OPEN-END ROTOR SPINNING DEVICE

(75) Inventors: Harry Gatzke, Mönchengladbach (DE); Hans-Josef Schröder, Mönchengladbach (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/542,153

(22) PCT Filed: Feb. 12, 2004

(86) PCT No.: PCT/EP2004/001299

§ 371 (c)(1),
(2), (4) Date: Jul. 13, 2005

(87) PCT Pub. No.: WO2004/083503

PCT Pub. Date: Sep. 30, 2004

(65) Prior Publication Data

US 2006/0137321 A1 Jun. 29, 2006

(30) Foreign Application Priority Data

Mar. 19, 2003 (DE) ..... 103 12 143
Jun. 14, 2003 (DE) ..... 103 26 847

(51) Int. Cl.
*D01H 4/08* (2006.01)

(52) U.S. Cl. ..... 57/417
(58) Field of Classification Search ..... 57/404–417

See application file for complete search history.

(56) References Cited

U.S. PATENT DOCUMENTS

| | | | | |
|---|---|---|---|---|
| 4,110,961 | A | 9/1978 | Havel et al. | 57/58.89 |
| 4,610,134 | A | 9/1986 | Busch et al. | 57/417 |
| 4,854,119 | A | 8/1989 | Stahlecker et al. | 57/417 |
| 5,638,671 | A | 6/1997 | Stahlecker et al. | 57/417 |
| 5,768,881 | A | 6/1998 | Lauschke | 57/414 |
| 5,794,430 | A * | 8/1998 | Grecksch et al. | 57/417 |
| 2004/0255569 | A1 * | 12/2004 | Stahlecker et al. | 57/417 |
| 2005/0229580 | A1 * | 10/2005 | Baur | 57/417 |

FOREIGN PATENT DOCUMENTS

| | | | |
|---|---|---|---|
| DE | 2745195 | A1 | 4/1978 |
| DE | 3343217 | A1 | 6/1985 |
| DE | 3729425 | A1 | 9/1988 |
| DE | 19502917 | A1 | 8/1996 |
| DE | 19532735 | A1 | 3/1997 |
| DE | 19934893 | A1 | 1/2001 |

* cited by examiner

*Primary Examiner*—Shaun R. Hurley
(74) *Attorney, Agent, or Firm*—Kennedy Covington Lobdell & Hickman, LLP

(57) ABSTRACT

The invention relates to a receiving element for receiving an interchangeable yarn drawing nozzle that can be magnetically locked. According to the invention, the receiving element is configured as an adapter (26), which can be screwed into a central threaded bore (37) of a thread channel plate (12) in an open-ended rotor spinning device (1), the latter being designed to receive a conventional yarn drawing nozzle that is equipped with an external thread. The adapter (26) comprises centring bores (27) for receiving ferromagnetic centring lugs (28) of a yarn drawing nozzle (13) in addition to a continuous bore (33), whose internal diameter (d) is adapter to the external diameter (D) of the shaft (39) of the yarn drawing nozzle (13). The adapter is also equipped with permanent magnetic pins (30), which correspond with the ferromagnetic centring lugs (28) of the yarn drawing nozzle (13).

9 Claims, 5 Drawing Sheets

RECEIVING ELEMENT FOR A YARN DRAWING NOZZLE OF AN OPEN-END ROTOR SPINNING DEVICE

CROSS-REFERENCES TO RELATED APPLICATIONS

This application claims the benefit of German patent applications 10312143.9 filed Mar. 19, 2003, and 10326847.2 filed Jun. 14, 2003, herein incorporated by reference.

BACKGROUND OF THE INVENTION

The invention relates to a receiving element for a yarn drawing nozzle of an open-end rotor spinning device.

In connection with open-end spinning devices, yarn draw-off nozzles, which are arranged exchangeably in a fiber channel plate which closes the rotor housing during the spinning operation, have been known for a long time.

German Patent Publication DE 33 43 217 A1 describes by way of example such a yarn draw-off nozzle, which can be exchangeably fixed in place in a fiber channel plate by means of a screw-thread arrangement.

In this case the yarn draw-off nozzle consists of a base body as well as a wear-resistant inlet funnel.

This means that the base body which, as a rule, is made of metal, has a through-bore, into whose inlet side an inlet funnel, made for example of a ceramic material, has been glued.

The base body furthermore has an exterior screw thread for screwing the yarn draw-off nozzle into a central screw thread of the fiber channel plate, and an exterior hexagon head for attaching a corresponding tool.

SUMMARY OF THE INVENTION

In principle, such yarn draw-off nozzles have proven themselves in actual use, but have the disadvantage that the exchange of such yarn draw-off nozzles is comparatively time-consuming, and that a tool is also required for changing these yarn draw-off nozzles.

It has therefore already been suggested to fix yarn draw-off nozzles magnetically to the fiber channel plate or to a fiber channel plate adapter inserted in the fiber channel plate.

For example, such magnetically attachable yarn draw-off nozzles have been extensively described in German Patent Publications DE 27 45 195 A1, DE 37 29 425 A1, DE 195 02 917 C2 or DE 195 32 735 A1.

As can be seen in particular in German Patent Publication DE 195 32 735 A1, such yarn draw-off nozzles consist of a ferromagnetic yarn draw-off nozzle holder, into whose through-bore a ceramic inlet funnel has been glued.

In this case the yarn draw-off nozzle holder has a cylindrical shaft, as well as an annular head element. Centering shoulders are arranged in the area of the head element, which work together with permanent magnet pins inserted into corresponding bores of the fiber channel plate. In the installed state of the yarn draw-off nozzle, the cylindrical shaft of the yarn draw-off nozzle holder is positioned in a corresponding through-bore of the fiber channel plate and is dependably secured against axial and rotatory displacement by the ferromagnetic centering shoulders or the permanent magnet pins.

The installation and removal of such magnetically fixed yarn draw-off nozzles is relatively simple and can be performed without an extensive outlay of time. Moreover, no tool is needed as a rule for exchanging such yarn draw-off nozzles.

An open-end spinning device with a special fiber channel plate is furthermore described in German Patent Publication DE 199 34 893 A1, which has a flange-like shoulder on the rear, on which a yarn draw-off tube can be releasably fixed in place. The fiber channel plate has a bore, which is conducted through the flange-like shoulder and is twice stepped at its entrance. The outside located step of the bore is provided with an interior screw thread.

A receiving element for the yarn draw-off nozzle is fastened on this interior screw thread via a corresponding exterior screw thread.

The yarn draw-off nozzle, which is arranged exchangeably in the receiving element, extends through the receiving element over its entire length and its end is supported in the stepped bore of the fiber channel plate.

The manner of fastening of the yarn draw-off nozzle in the receiving element, or further details regarding the receiving element cannot be found in DE 199 34 893 A1.

Starting from the above mentioned prior art, the object of the invention is based on producing a receiving element which makes it possible to also fix magnetically arrestable yarn draw-off nozzles in a fiber channel plate which had originally been designed for receiving screwable yarn draw-off nozzles.

In accordance with the invention, this object is attained by means of an adapter. A receiver element embodied as an adapter for receiving an exchangeable yarn draw-off nozzle, wherein the receiver element can be screwed into a central threaded bore of a fiber channel plate of an open-end rotor spinning device, which is designed for receiving a conventional yarn draw-off nozzle equipped with an exterior screw thread. The adapter has centering bores for receiving ferromagnetic centering shoulders of a magnetically arrestable yarn draw-off nozzle, as well as a through-bore, whose interior diameter is matched to the exterior diameter of the shaft of the yarn draw-off nozzle. Permanent magnet pins are provided, which work together with the ferromagnetic shoulders of the yarn draw-off nozzle.

The receiving element embodied as an adapter has the particular advantage that fiber channel plates, which have a central threaded bore for receiving a yarn draw-off nozzle which can be screwed in, can also later be retrofitted without problems in such a way that a secure insertion of magnetically arrestable yarn draw-off nozzles is possible.

For this purpose, the adapter has an exterior screw thread, as well as a through-bore.

In this case the interior diameter of the through-bore is matched to the exterior diameter of the shaft of a magnetically arrestable yarn draw-off nozzle.

The adapter furthermore has centering bores for receiving the ferromagnetic centering shoulders of the yarn draw-off nozzle.

The adapter in accordance with the invention makes it possible to modify technically slightly outmoded fiber channel plates without a large time and material outlay in such a way that modem yarn draw-off nozzles can also be used.

In connection with a first one-piece embodiment it is provided that the adapter has a circular head element which, in the installed state, is at least partially positioned in a corresponding recess of the fiber channel plate.

Centering bores are arranged in the head element, which work together with the centering shoulders of the yarn draw-off nozzle and in this way assure an exact, reproducible installed position between the yarn draw-off nozzle and the adapter.

The embodiment represented in particular in FIG. 4 makes possible an optimal positioning of the yarn draw-off nozzle in the fiber channel plate in relation to the spinning rotor of the open-end rotor spinning device.

This means that, because of the employment of the adapter in accordance with the invention, a problem-free reproducible installation and removal and a dependable fixation of magnetically arrestable yarn draw-off nozzles in fiber channel plates equipped with a central threaded bore is possible.

It is provided in the first embodiment to position permanent magnet pins in the centering bores of the head element.

Here, the permanent magnet pins are arranged recessed.

This means that the permanent magnet pins are each arranged slightly offset toward the rear in relation to the mouth of the centering bore.

Such an arrangement assures that a comparatively high magnetic adhesive force is exerted on the yarn draw-off nozzle. By means of this it has been assured that the yarn draw-off nozzle dependably remains in its preset position during the spinning operation.

In a further alternative two-part embodiment described in FIG. 5, the adapter in accordance with the invention has a fastening element and a centering ring, which is rotatably seated in respect to the fastening element.

In this case, in an advantageous embodiment the centering ring is equipped with centering bores, as well as with at least one centering pin, wherein the centering pin works together with a respective centering bore in the fiber channel plate.

In the course of installing the adapter, the centering pin at the centering ring dependably engages the corresponding centering bore in the fiber channel plate and in this way sets the exact position of the centering bores of the centering ring.

This means that the centering bores of the centering ring are exactly positioned in the area of permanent magnet pins which have been fixed in place in corresponding bores of the fiber channel plate.

To prevent the entry of false air into the open-end spinning device, the adapter is furthermore equipped with an O-ring seal.

The adapter is preferably made of aluminum.

This material is not only very corrosion-resistant, but also relatively easy to work and relatively cost-effective.

In what follows, the invention will be explained in greater detail by means of the exemplary embodiments represented in the drawings.

DETAILED DESCRIPTION OF THE PREFERRED EMBODIMENTS

Figure 1:
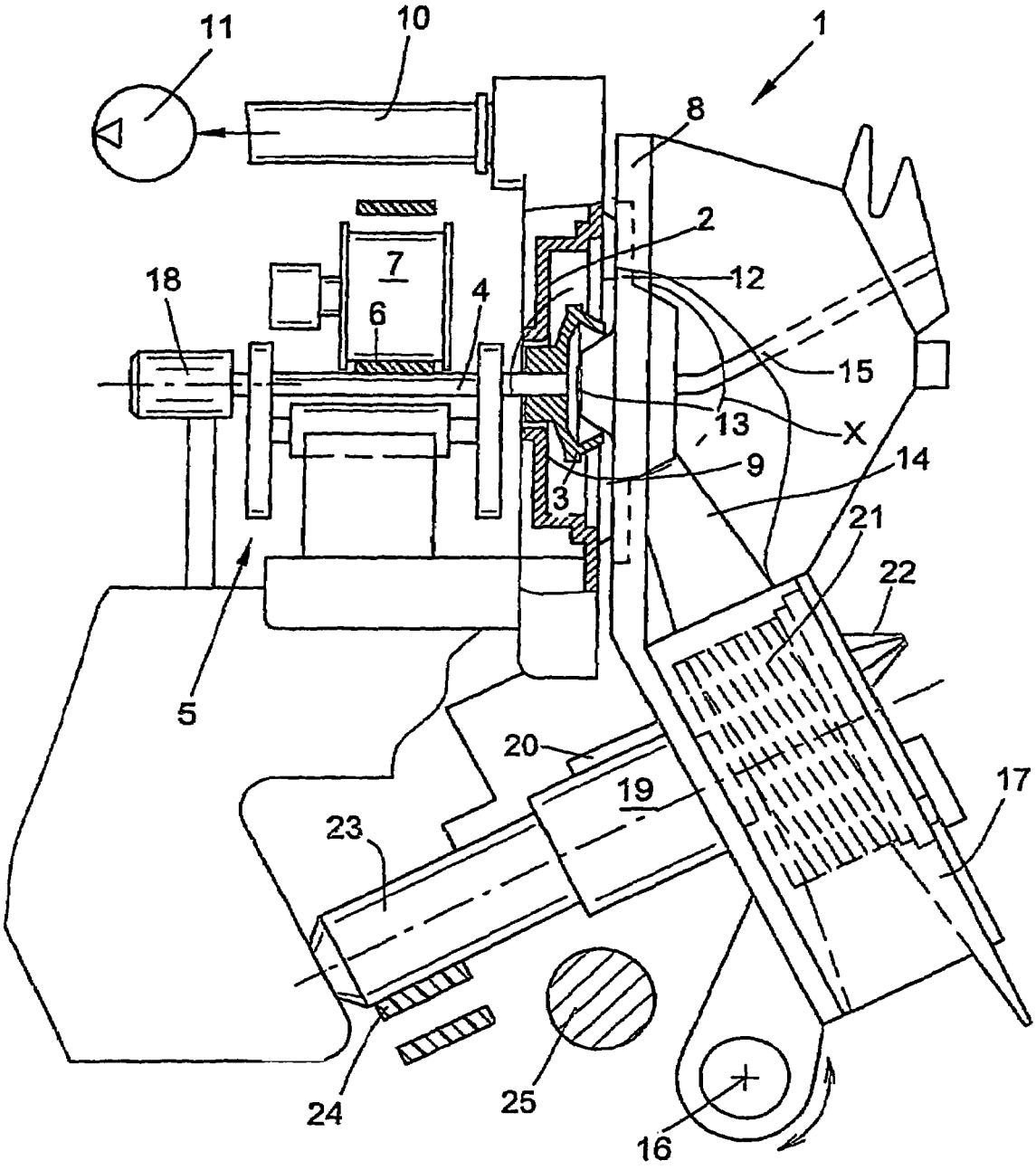
FIG. 1, an open-end rotor spinning device in a lateral view.

The open-end rotor spinning device represented in FIG. 1 as a whole has the reference numeral 1.

In a known manner the rotor spinning device has a rotor housing 2, in which the spinning cup of a spinning rotor 3 revolves at a high number of revolutions during the spinning operation. Here, the spinning rotor 3 is supported with its rotor shaft 4 in the bearing nip of a supporting ring bearing 5, and is operated by means of a tangential belt 6, which extends over the length of the machine and is placed against it by means of a contact roller 7.

The axial fixation of the motor shaft 4 preferably takes place via a permanent magnetic axial bearing 18.

As is customary, the rotor housing 2, which per se is open at the front, is covered during the spinning operation by a pivotably seated cover element 8, into which a fiber channel plate 12 has been inserted with a seal 9. The rotor housing 2 is furthermore connected via an appropriate suction line 10 to a negative pressure source 11, which generates the negative spinning pressure required in the rotor housing 2.

As indicated above, a fiber channel plate 12 is arranged, preferably exchangeably, in the cover element 8, in which a yarn draw-off nozzle 13 has been fixed, also exchangeably if required, to which a small yarn draw-of tube 15 is connected.

In the customary manner, the fiber channel plate 12 furthermore contains the mouth area of a fiber guide channel 14.

The cover element 8, which is seated, pivotable to a limited extent, around a pivot shaft 16, has an opening roller housing 17, as well as bearing brackets 19, 20, which are arranged on the rear for seating an opening roller 21, or a sliver draw-in cylinder 22.

In this case the opening roller 21 is driven in the area of its wharve 23 by a revolving tangential belt 24 extending over the length of the machine, while the drive mechanism (not represented) of the sliver draw-in cylinder 22 is preferably performed by means of a worm drive gear arrangement which is connected to a drive shaft 25 extending over the length of the machine.

As can be seen from FIGS. 2 to 5 in particular, the fiber channel plate 12 has a central threaded bore 37 with an interior screw thread 36, as well as a recess 32 on the inlet side. A receiving element in accordance with the invention, embodied as an adapter 26, can be fixed in place in this central threaded bore 37 by means of a corresponding exterior screw thread 35. In this case, the adapter 26 either has the first, one-piece embodiment, described by means of FIGS. 2 and 3 in what follows, or is embodied in two pieces, as shown by means of FIGS. 4 and 5.

Figure 2:
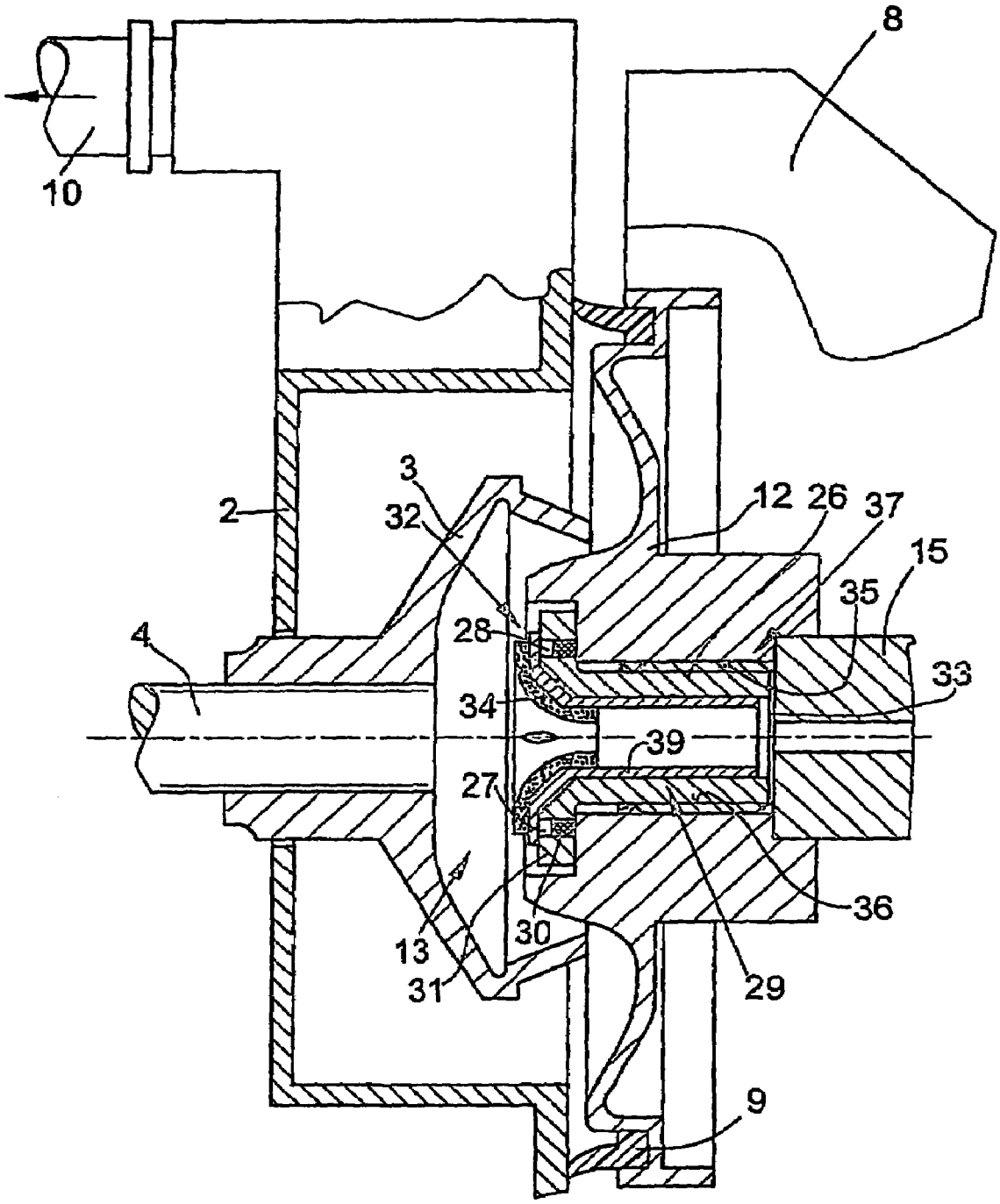
FIG. 2, the detail X in FIG. 1 on an enlarged scale with a first, one-piece embodiment of the adapter in accordance with the invention, FIG. 3, the adapter of FIG. 2 with a magnetically arrestable yarn draw-off nozzle holder, as well as with a fiber channel plate equipped with an interior screw thread, partially in section, FIG. 4, an alternative two-piece embodiment of the adapter of the invention with a magnetically arrestable yarn draw-off nozzle holder, as well as with a fiber channel plate equipped with an interior screw thread, partially in section, FIG. 5, an arrangement in accordance with FIG. 4, perspectively.
Figure 3:
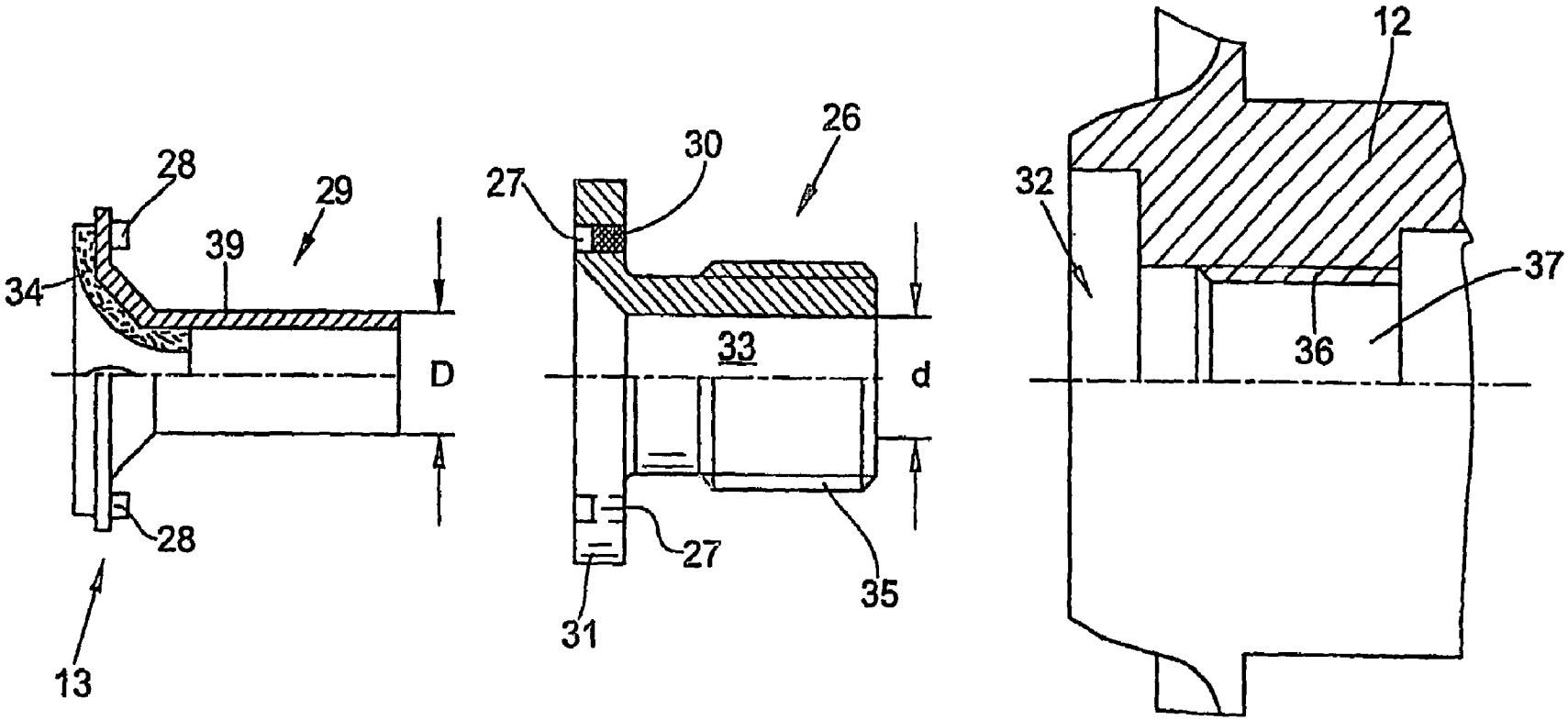

In the first embodiment represented in FIGS. 2 and 3, the one-piece adapter 26 has an exterior screw thread 35, a through-bore 33, as well as a ring-shaped head element 31 with centering bores 27.

Permanent magnet pins 30 have been fixed here, slightly set back in relation to the bore mouth, in the centering bores 27, and work together with corresponding ferromagnetic centering shoulders 28 of the yarn draw-off nozzle 13. The interior diameter d of the through-bore 33 of the adapter 26 is matched to the exterior diameter D of the cylindrical shaft 39 of a base body 29 of the yarn draw-off nozzle 13. As indicated in FIG. 3, the base body 29 here has a ceramic inlet funnel 34 in its inlet area, which has been permanently connected, preferably by gluing, with the shaft 39. The adapter 26 in accordance with the invention can be screwed into the central threaded bore 37 of the fiber channel plate 12 of the open-end spinning device 1 via the exterior screw thread 35. In this case the exterior screw thread 35 of the adapter 26 works together with the interior screw thread 36 of the fiber channel plate 12.

In the installed state the ring-shaped head element 31 of the adapter 26 which has, as previously indicated, centering bores 27 in which permanent magnet pins 30 have been positioned, lies in the recess 32 of the fiber channel plate 12.

It is then possible to fix a magnetically arrestable yarn draw-off nozzle 13 in the installed adapter 26 without problems and in an easily exchangeable manner.

In this case the cylindrical shaft 39 of the base body 29 of the yarn draw-off nozzle 13 is seated in the through-bore 33 of the adapter 26 and the centering shoulders 28 engage the centering bores 27 of the adapter 26.

Figure 4:
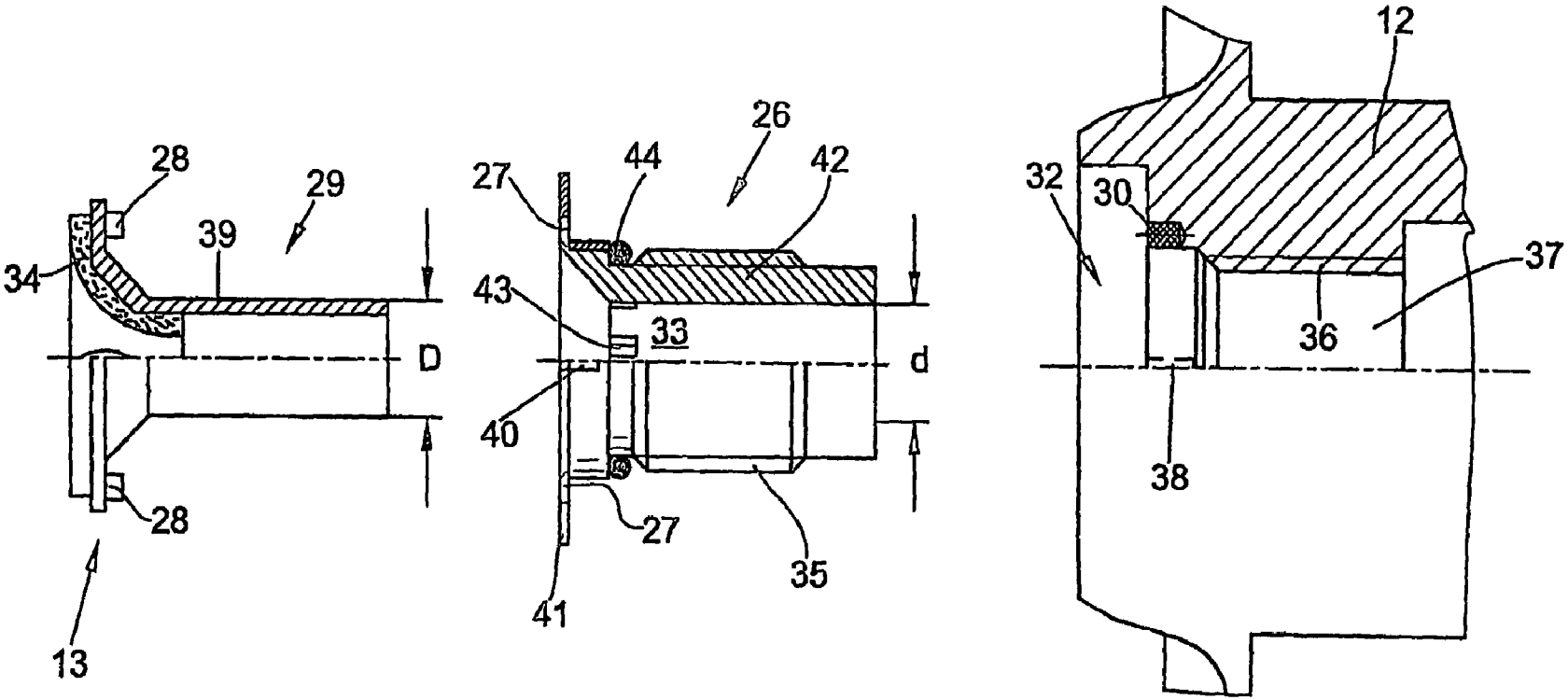
Figure 5:
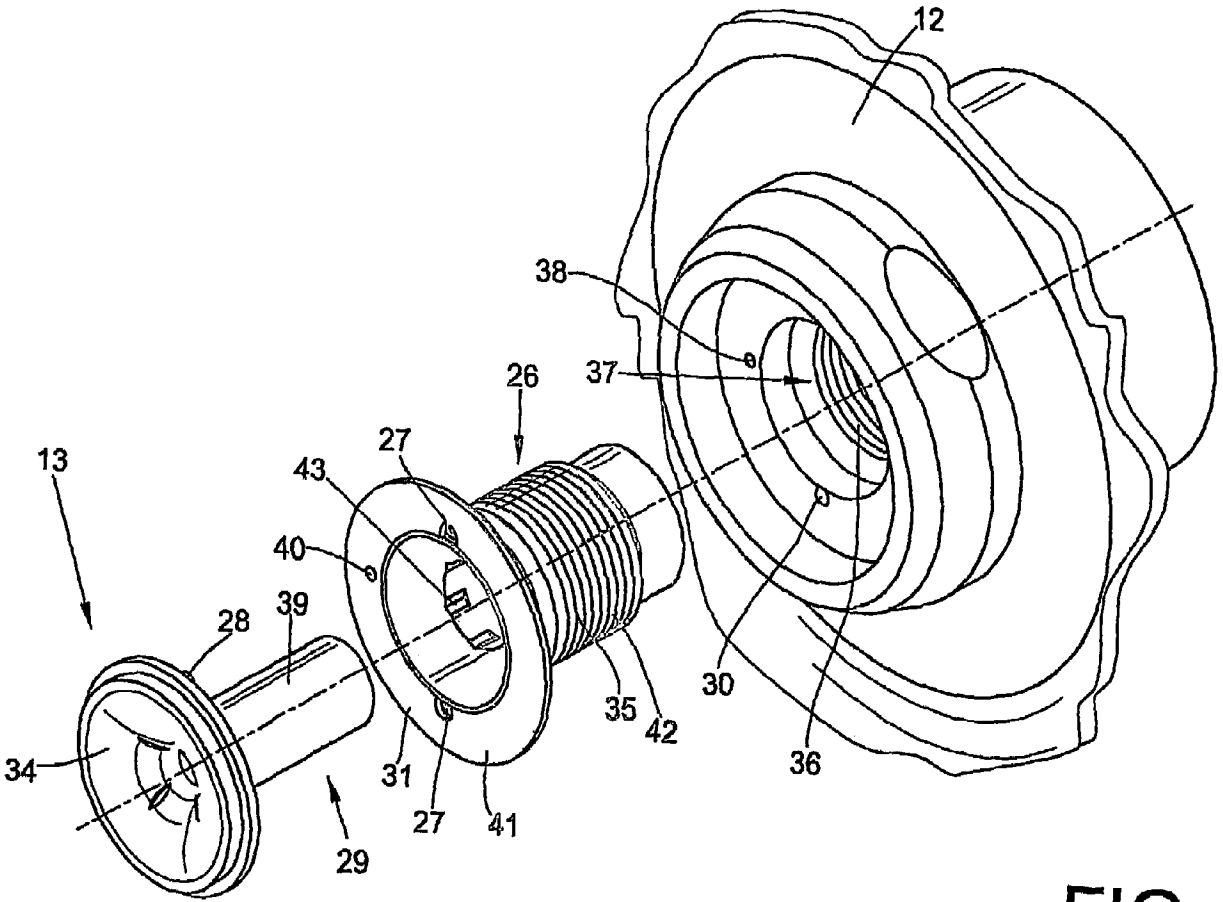

In its alternative two-piece embodiment, described in what follows by means of FIGS. 4 and 5, the adapter 26 consists of a fastening element 42, as well as a centering ring 41 rotatably seated on the fastening element 42.

As with the one-piece embodiment, the fastening element 42 has an exterior screw thread 35, as well as a through-bore 33.

A centering pin 40 is arranged on the centering ring 41 which, in the installed state of the adapter 26, engages a corresponding centering bore 38 in the fiber channel plate 12 and aligns the centering pin 41 in such a way that the centering bores 27, also arranged in the centering ring 41, for the ferromagnetic centering shoulders 28 of the yarn draw-off nozzle 13 have been positioned congruently with the permanent magnet pins 30, which in turn have been fixed in place in bores in the fiber channel plate 12.

With this embodiment, too, the interior diameter d of the through-bore 33 of the adapter 26 is matched to the exterior diameter D of the cylindrical shaft 39 of the yarn draw-off nozzle.

Furthermore, the two-part embodiment of the adapter 26 in accordance with the invention is here also screwed by means of the external screw thread 35 into the central threaded bore 37 of the fiber channel plate 12 of the open-end rotor spinning device 1.

In this case the exterior screw thread 35 of the adapter 26 works together with the interior screw thread 36 of the fiber channel plate 12.

It is possible to fix a magnetically arrestable yarn draw-off nozzle 13 without problems and in an easily exchangeable manner in place in the adapter 26 embodied in two pieces.

In this case the cylindrical shaft 39 of the base body 29 of the yarn draw-off nozzle 13 is in the through-bore 33 of the adapter 26 and its ferromagnetic centering shoulders 28 the centering bores 27 of the centering ring 41.

The invention claimed is:

1. A receiver element for receiving an exchangeable yarn draw-off nozzle, characterized in that the receiver element is embodied as an adapter, which can be screwed into a central threaded bore of a fiber channel plate of an open-end rotor spinning device (1), which is designed for receiving a conventional yarn draw-off nozzle equipped with an exterior screw thread, the adapter has centering bores for receiving ferromagnetic centering shoulders of a magnetically arrestable yarn draw-off nozzle, as well as a through-bore, whose interior diameter is matched to the exterior diameter of the shaft of the yarn draw-off nozzle, and permanent magnet pins are provided, which work together with the ferromagnetic shoulders of the yarn draw-off nozzle.

2. The receiver element in accordance with claim 1, wherein the centering bores (27) are arranged in a ring-shaped head element of the adapter which, in the installed state of the adapter, is at least partially positioned in a corresponding recess of the fiber channel plate.

3. The receiver element in accordance with claim 2, wherein permanent magnet pins are arranged in the area of the centering bores.

4. The receiver element in accordance with claim 3, wherein the permanent magnet pins are arranged slightly set back in relation to the bore mouth inside the centering bores.

5. The receiver element in accordance with claim 1, wherein the adapter has a fastening element and a centering ring, which is rotatably seated in respect to the fastening element.

6. The receiver element in accordance with claim 5, wherein the centering ring is equipped with centering bores, as well as with at least one centering pin, wherein the centering pin works together with a centering bore in the fiber channel plate.

7. The receiver element in accordance with claim 1, wherein the permanent magnet pins are arranged in corresponding bores of the fiber channel plate.

8. The receiver element in accordance with claim 1, wherein the adapter has an O-ring seal.

9. The receiver element in accordance with claim 1, wherein the adapter is made of aluminum.

* * * * *